United States Patent [19]

Horita

[11] Patent Number: 4,888,859

[45] Date of Patent: Dec. 26, 1989

[54] WATER-TIGHT SLIDE FASTENER

[75] Inventor: Yoshiyuki Horita, Toyama, Japan

[73] Assignee: Yoshida Kogyo K.K., Tokyo, Japan

[21] Appl. No.: 231,346

[22] Filed: Aug. 11, 1988

[30] Foreign Application Priority Data

Aug. 12, 1987 [JP] Japan ..... 62-202267

[51] Int. Cl.[4] ..... A44B 19/32

[52] U.S. Cl. ..... 24/389; 24/394

[58] Field of Search ..... 24/394, 397, 398, 384, 24/389, 408

[56] References Cited

U.S. PATENT DOCUMENTS 3,501,816 3/1970 Heimberger ..... 24/389
3,914,827 10/1975 Brown et al. .
4,153,980 5/1979 Moertel .
4,724,586 2/1988 Tsubokawa et al. .

FOREIGN PATENT DOCUMENTS 0164610 12/1985 European Pat. Off. .
795762 1/1936 France .
543865 12/1973 Japan .
59-108502 6/1984 Japan .

*Primary Examiner*—James R. Brittain
*Attorney, Agent, or Firm*—Hill, Van Santen, Steadman & Simpson

[57] ABSTRACT

A water-tight slide fastener is disclosed, which comprises a pair of support tapes each coated on one surface with a water-resistant material and a row of coupling elements mounted on each of the tapes along its longitudinal edge. The spaces or gaps defined in the row of elements being completely filled by a filling core when the latter swells in contact with a liquid to prevent entry of the liquid into a garment to which the fastener is applied.

5 Claims, 2 Drawing Sheets

WATER-TIGHT SLIDE FASTENER

BACKGROUND OF THE INVENTION

1. Field of the Invention

This invention relates to slide fasteners, more particularly a water-tight slide fastener.

2. Prior Art

There are known a variety of water-tight slide fasteners, a typical example of which is disclosed in Japanese Laid-Open Patent Publication No. 59-108502. Such prior art slide fasteners are rendered water-tight, to prohibit entry of water into an article to which the slide fastener is applied, by coating one or both surfaces of the fastener tapes with a suitable water-resistant or repellant coating material and further by maintaining the confronting edges of the opposed tapes in intimate abutting, sealing contact with each other when the fastener is closed.

However, the prior art water-tight slide fastener has a drawback in that due to tight sealing closure of the confronting tape edges, the slider is subject to increased sliding resistance and would often become sluggish, if not impossible, in its reciprocating movement to open or close the fastener. Another drawback is found in that the fastener when subjected to severe lateral pull is apt to lose its sealing effect at the junction of the two opposed tape edges along which rows of coupling elements are mounted.

SUMMARY OF THE INVENTION

It is therefore the primary object of the present invention to eliminate the foregoing drawbacks of the prior art.

A more specific object of the invention is to provide a water-tight slide fastener constructed on a unique inventive concept that water-tightness is achieved basically at the region of the fastener where its coupling elements are located, in addition to the provision of a water-tight tape web, whereby the slider retains its smooth reciprocating movement and the fastener is rendered highly resistant to lateral pull or transverse pressure tending to spread apart the opposed halves of the fastener.

According to the invention, there is provided a water-tight slide fastener which comprises a pair of oppositely disposed support tapes, a row of fastener coupling elements, each having a coupling head, and an upper leg portion, a lower leg portion and a heel portion and secured by sewing threads to and along an inner longitudinal edge of each of the respective support tapes, and a filling core extending through spaces defined in said row of coupling elements and initially filling said spaces except for the region of said coupling head, said core being capable of swelling upon contact with a liquid and completely filling up said spaces against entry of the liquid into the interior of an article to which the fastener is applied, and said support tape being coated with a water-resistant coating material on one of its surfaces and on its longitudinal marginal edge.

The above and other objects and features of the invention will be better understood from the following detailed description taken in conjunction with the accompanying drawings in which like reference numerals refer to like or corresponding parts throughout the several views.

DETAILED DESCRIPTION

Figure 1:
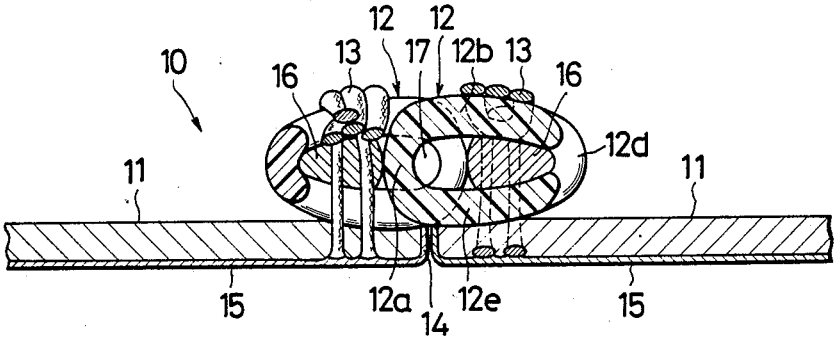
FIG. 1 is a transverse cross-sectional view on enlarged scale of a water-tight slide fastener embodying the invention, showing the fastener in dry condition.

Referring now to the drawings and FIG. 1 in particular, that is shown a slide fastener 10 which has a water-tight function according to the present invention.

The slide fastener 10 is conventional in that it comprises a pair of oppositely disposed support tapes 11 and a row of fastener coupling elements 12 secured by sewing threads or seams 13 to and along an inner longitudinal edge of each of the respective support tapes 11, the opposed rows of coupling elements 12 being taken into and out of coupling engagement with each other by a slider not shown. The support tape may be a fabric of woven or knitted structure. It is coated on its back surface including sewn seams 13 and on the inner longitudinal marginal edge 14 with a layer of material 15 which is air-permeative but liquid-impermeative such as for example a polyurethane resin.

The coupling elements 12 are in the form of a continuous helical coil as presently shown in the illustrated embodiments, although the invention is not limited thereto. The coupling element 12 taken as an individual unit comprises a coupling head portion **12*a*, an upper leg portion 12*b*, a lower leg portion 12*c* and a heel portion 12*d* connecting the leg portions to adjacent counterparts in the row of elements 12**.

Figure 2:
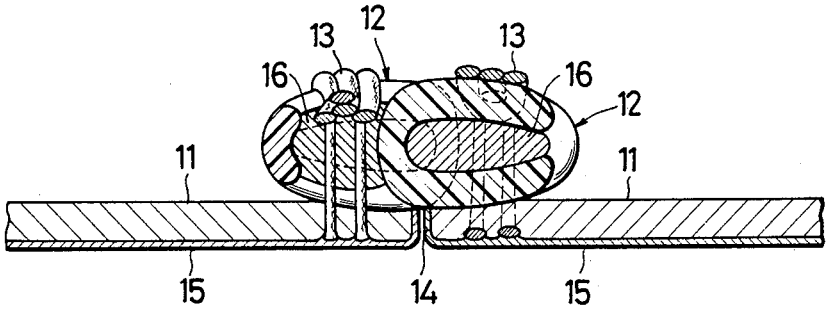
FIG. 2 is a view similar to FIG. 1 but showing the fastener in wet condition.
Figure 3:
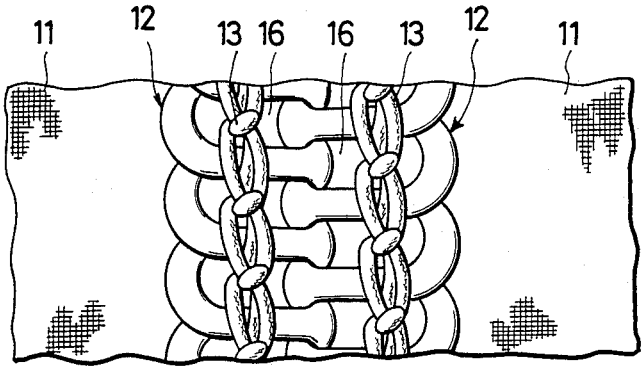
FIG. 3 is a plan view of a portion of the slide fastener shown in FIG. 2.

Designated at 16 is a filling core or cord which extends longitudinally through spaces or gaps 17 defined in the row of coupling elements 12 and fills that region of space 17 which is defined by the leg portions **12*b*, 12*c* and the heel portion 12*d*, initially leaving the space unfilled adjacent to the coupling head 12*a* as shown in FIG. 1. The filling core 16 is formed from a polymeric fibrous material which is highly water absorptive and capable of swelling to a multiple gravity upon wetting with water as shown in FIGS. 2 and 3** and further highly water retentive against pressure in normal use.

An example of such polymeric material is commercially available under the tradename of Lanceal-F of Japan Exlan Industries Ltd.

Figure 4:
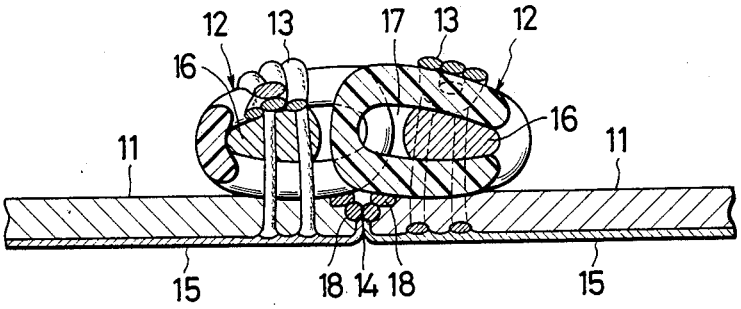
FIG. 4 is a view similar to FIG. 1 but showing a modified form of water-tight slide fastener.

FIG. 4 shows a modification of water-tight slide fastener 10 which includes a plurality of water-absorptive strands 18 of a similar fibrous material to the filling core 16, the strands 18 being provided along each of the longitudinal marginal tape edges 14 disposed in confronting relation as warp yarns either woven or knitted into the tape system to enhance water-tightness of the fastener 10.

Figure 5:
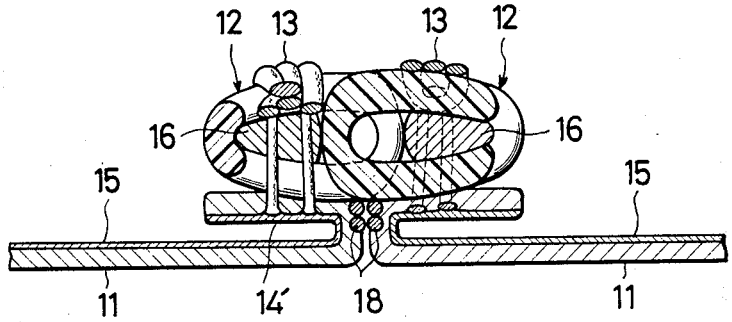
FIG. 5 is a transverse cross-sectional view of a water-tight slide fastener of a concealed construction.

FIG. 5 shows a concealed type of slide fastener 10 which carries a row of coupling elements 12 on and along a folded edge portion 14', to which the principles of the invention are applied in which each of the tapes 11 is coated with the water-tight layer 15 on one of its surfaces including the folded edge portion 14' and provided with the water-absorptive strands 18 at the confronting abutting edges of the opposed tapes 11.

When the slide fastener 10 thus constructed is put to use in a water or other liquid phase environment as in the case of ski wear, jogging wear, sports bags and the like, the filling core 16 swells in volume to an extent sufficient to fill up the spaces or gaps in between the individual coupling elements 12 in the opposed rows thereby preventing entry or permeation of liquids into the interior of the garment or other articles to which the slide fastener 10 is applied. Because of the physical characteristics of the material of the filling core 16, this fastener component absorbs and retains water against leaking under the influence of pressure in normal use of the fastener 10 and allows the slider to move smoothly regardless of whether the core 16 is dry or wet.

Obviously, various modifications and variations of the present invention are possible in the light of the above teaching. It is therefore to be understood that within the scope of the appended claims the invention may be practiced otherwise than as specifically described.

What is claimed is:

1. A water-tight slide fastener which comprises a pair of oppositely disposed support tapes, a row of fastener coupling elements, each having a coupling head, and an upper leg portion, a lower leg portion and a heel portion and secured by sewing threads to and along an inner longitudinal edge of each of the respective support tapes, and a filling core extending through spaces defined in said row of coupling elements and initially filling said spaces except for the region of said coupling head, said core having means rendering it capable of swelling upon contact with a liquid and completely filling up said spaces against entry of the liquid into the interior of an article to which the fastener is applied, and said support tape being coated with a water-resistant coating material on one of its surfaces and on its longitudinal marginal edge.

2. A water-tight slide fastener according to claim 1 which further comprises a plurality of water-absorptive strands extending along each of said marginal edges in confronting relation.

3. A water-tight slide fastener according to claim 2 wherein said strands are wrap yarns woven or knitted into said tape.

4. A water-tight slide fastener according to claim 1 wherein said coating material is a polyurethane resin.

5. A water-tight slide fastener according to claim 1 wherein said means rendering said filling core capable of swelling upon contact with a liquid comprises forming said core from a highly water-absorptive and water-retentive fibrous material.

* * * * *